US008345884B2

(12) United States Patent
Nomura

(10) Patent No.: US 8,345,884 B2
(45) Date of Patent: Jan. 1, 2013

(54) SIGNAL SEPARATION REPRODUCTION DEVICE AND SIGNAL SEPARATION REPRODUCTION METHOD

(75) Inventor: Toshiyuki Nomura, Tokyo (JP)

(73) Assignee: NEC Corporation, Tokyo (JP)

( * ) Notice: Subject to any disclaimer, the term of this patent is extended or adjusted under 35 U.S.C. 154(b) by 811 days.

(21) Appl. No.: 12/518,727

(22) PCT Filed: Dec. 7, 2007

(86) PCT No.: PCT/JP2007/073677

§ 371 (c)(1),
(2), (4) Date: Jun. 11, 2009

(87) PCT Pub. No.: WO2008/072566

PCT Pub. Date: Jun. 19, 2008

(65) Prior Publication Data

US 2010/0030554 A1 Feb. 4, 2010

(30) Foreign Application Priority Data

Dec. 12, 2006 (JP) ..... 2006-334440

(51) Int. Cl.
*H04R 5/00* (2006.01)

(52) U.S. Cl. ..... 381/18; 381/15; 381/94.3; 381/94.7; 381/17; 381/22; 704/201; 704/500; 704/243; 704/228; 375/130; 375/140; 375/144; 370/307

(58) Field of Classification Search ..... 381/18, 381/15, 22, 61, 27, 94.3, 94.7, 28, 17; 704/201, 704/500–504, 243, 227, 228, 221, 205; 375/130, 375/140, 144, 146, 147; 370/307
See application file for complete search history.

(56) References Cited

U.S. PATENT DOCUMENTS 6,590,871 B1 * 7/2003 Adachi ..... 370/307
7,200,561 B2 * 4/2007 Moriya et al. ..... 704/500
(Continued)

FOREIGN PATENT DOCUMENTS

JP 8-110794 A 4/1996
(Continued)

OTHER PUBLICATIONS

Katsuyuki Sawai et al.; "Semi Blind Separation of moving sound sources based on ICA using Direction of Arrival Information"; IEICE Technical Report, EA2001-34 (Aug. 2001), pp. 49-56.

(Continued)

*Primary Examiner* — Vijay B Chawan
(74) *Attorney, Agent, or Firm* — Dickstein Shapiro LLP

(57) ABSTRACT

A first matrix (W(k)) indicating frequency characteristics of a separation filter is calculated from input signals of a plurality of channels. A second matrix (Ws(k)) is calculated by using the restriction coefficients ($C_i$(k)) for restricting the separation filter and the first matrix, and separation filter coefficients ($ws_{ij}$(s)) are calculated by using the second matrix. With use of the separation filter coefficients, separation signals ($ys_i$(t)) are then calculated from the input signals. A third matrix ($Ws^{-1}$(k)) is then calculated by transforming the second matrix into an inverse matrix at each frequency, and reproduction filter coefficients ($a'_{I1}$(s), $a'_{I2}$(s)) are calculated by using the third matrix. With use of the reproduction filter coefficients, the synthesized signal of each channel is calculated by using the separation signals. The restriction coefficients are calculated so that the reproduction filter coefficients indicate filter coefficients which perform a sound source localization on the separation signals.

18 Claims, 4 Drawing Sheets

U.S. PATENT DOCUMENTS

| | | | | |
|---|---|---|---|---|
| 7,593,449 | B2 * | 9/2009 | Shattil | 375/130 |
| 7,894,611 | B2 * | 2/2011 | Beckmann et al. | 381/18 |
| 8,160,273 | B2 * | 4/2012 | Visser et al. | 381/94.7 |
| 2002/0073128 | A1 | 6/2002 | Egelmeers et al. | |
| 2003/0046064 | A1 * | 3/2003 | Moriya et al. | 704/201 |
| 2009/0022336 | A1 * | 1/2009 | Visser et al. | 381/94.7 |

FOREIGN PATENT DOCUMENTS

| | | | |
|---|---|---|---|
| JP | 11-109014 | A | 4/1999 |
| JP | 2000-181499 | A | 6/2000 |
| JP | 2002-149190 | A | 5/2002 |
| JP | 2003-333682 | A | 11/2003 |
| JP | 2004-507923 | A | 3/2004 |
| JP | 2004-523752 | A | 8/2004 |
| JP | 2004-302122 | A | 10/2004 |
| JP | 2005-091560 | A | 4/2005 |
| JP | 2005-266797 | A | 9/2005 |
| JP | 2006-017961 | A | 1/2006 |
| JP | 2006-084928 | A | 3/2006 |
| JP | 2006-154314 | A | 6/2006 |
| WO | WO-02/17488 | A1 | 2/2002 |
| WO | WO-2005/024788 | A1 | 3/2005 |

OTHER PUBLICATIONS

Shuxue Ding, Masashi Otsuka, Masaki Ashizawa, Teruo Niitsuma, and Kazuyoshi Sugai; "Blind Source Separation of Real-World Acoustic Signals Based on ICA in Time-Frequency-Domain"; Technical Report of IEICE, SP2001-1, pp. 1-8, Apr. 2001.

* cited by examiner

SIGNAL SEPARATION REPRODUCTION DEVICE AND SIGNAL SEPARATION REPRODUCTION METHOD

TECHNICAL FIELD

The present invention relates to a technique for separating and reproducing acoustic signals, and more particularly, to a technique for separating and reproducing different acoustic signals that are mixed with one another.

BACKGROUND ART

FIG. 4 shows an example of a conventional signal separating and reproducing apparatus that processes acoustic signals. This structure has two channels for input signals. As shown in FIG. 4, the signal separating and reproducing apparatus 1000 includes two input terminals 1 and 2, a separation filter analyzing unit 3, a separation and reproduction filter calculating unit 4, a separation and reproduction filter unit 5, a separation and reproduction filter unit 6, four output terminals 7, 8, 9, and 10.

The signal separating and reproducing apparatus 1000 operates in the following manner. Individual channel input signals $X_j(t)$ are supplied to the input terminal 1 and the input terminal 2. Here, j indicates the channel number (j=1, 2), and t indicates the time sample number. Both individual channel input signals are supplied to the separation filter analyzing unit 3.

The separation filter analyzing unit 3 separates acoustic and voice signals that are convoluted in the individual channel input signals. More specifically, the separation filter analyzing unit 3 performs a frequency transform on each of the individual channel input signals, so as to calculate a frequency sequence $X_j(k,n)$. Here, k indicates the frequency component number (k=0, 1, . . . , N/2−1), N indicates the block length of the frequency transform, and n presents the frame number (n=0, 1, . . . ). The separation filter analyzing unit 3 regards every frequency component as an instantaneous mixture, and carries out an independent component analysis (hereinafter referred to as the "frequency region independent component analysis"), so as to calculate a separation filter frequency characteristics matrix W(k).

The separation filter frequency characteristics matrix W(k) is a matrix formed with two rows and two columns, with $W_{ij}(k)$ being the elements of the matrix as shown in the following equation. Here, i presents the separation signal number (i=1, 2), and j indicates the channel number.

{Math. 1}

$$W(k) = \begin{pmatrix} W_{11}(k) & W_{12}(k) \\ W_{21}(k) & W_{22}(k) \end{pmatrix} \tag{1}$$

The frequency region independent component analysis is a technique for separating linearly-coupled signals, based on the statistical independence between signals. Such a technique is disclosed in the later described Non Patent Literature 1, for example. It is known that such a frequency region independent component analysis has the problem that the order of separation signal numbers (i=1, 2) of the matrix elements $W_{ij}(k)$ at the respective frequency components becomes uncertain, and the problem that the sizes of the matrix elements $W_{ij}(k)$ at the respective frequency components become uncertain. To eliminate the uncertainty about the order, which is the former problem, there is a technique by which the continuity of the frequency direction is used, or a technique by which the arrival direction is used, for example.

To solve the problem about the sizes of the matrix elements, which is the latter problem, the following technique has been known. In a case where a separation and reproduction filter frequency characteristics matrix $M_i(k)$ is generated by combining the separation filter frequency characteristics matrix W(k) and the reproduction filter frequency characteristics matrix $W^{-1}(k)$, which is the inverse matrix formed from the separation filter frequency characteristics matrix W(k) at the respective frequencies, uncertainty is not caused in the sizes of the matrix elements. The separation and reproduction filter frequency characteristics matrix $M_i(k)$ is expressed by the following equation (2):

$$M_i(k)=W^{-1}(k)\cdot P_i(k)\cdot W(k) i=1,2 \tag{2}$$

Here, only the element on the ith row and the ith column of the matrix $P_i(k)$ is "1", and the other elements of the matrix $P_i(k)$ are "0", as expressed by the following equation (3):

{Math. 2}

$$P_1(k) = \begin{pmatrix} 1 & 0 \\ 0 & 0 \end{pmatrix}, \quad P_2(k) = \begin{pmatrix} 0 & 0 \\ 0 & 1 \end{pmatrix} \tag{3}$$

A matrix W'(k) that is formed by adding coefficients a(k) and b(k) indicating the size uncertainties of the matrix elements of the separation filter frequency characteristics matrix W(k) to the separation filter frequency characteristics matrix W(k) is expressed by the following equation (4):

{Math. 3}

$$W'(k) = \begin{pmatrix} a(k) & 0 \\ 0 & b(k) \end{pmatrix} \cdot W(k) \tag{4}$$

The separation and reproduction filter frequency characteristics matrix $M'_i(k)$ using the above matrix W'(k) can be expressed by the following equation (5):

{Math. 4}

$$\begin{aligned} M'_i(k) &= W'^{-1}(k)\cdot P_i(k)\cdot W'(k) \\ &= W^{-1}(k)\cdot \begin{pmatrix} a(k) & 0 \\ 0 & b(k) \end{pmatrix}^{-1} \cdot P_i(k)\cdot \begin{pmatrix} a(k) & 0 \\ 0 & b(k) \end{pmatrix} \cdot W(k) \\ &= W^{-1}(k)\cdot P_i(k)\cdot W(k) \\ &= M_i(k) \end{aligned} \tag{5}$$

As is apparent from the above, the separation and reproduction filter frequency characteristics matrix does not contain uncertainty about the sizes of the matrix elements.

The separation and reproduction filter calculating unit 4 performs an operation to eliminate the uncertainty about the sizes by the above described technique. More specifically, the reproduction filter frequency characteristics matrix $W^{-1}(k)$ is calculated by transforming the separation filter frequency characteristics matrix W(k) into an inverse matrix at the respective frequencies. The matrix $W^{-1}(k)$ and the original matrix W(k) are then combined, so that the above mentioned separation and reproduction filter frequency characteristics matrix $M_i(k)$ is calculated. Further, an inverse frequency transform is performed on the separation and reproduction filter frequency characteristics matrix $M_i(k)$ for each of the matrix elements $M_{ij}^{(i)}(k)$ (i=1, 2; I=1, 2; j=1, 2), so as to calculate eight separation and reproduction filter coefficients $M_{ij}^{(i)}(s)$ (s=0, 1, . . . , N−1). Here, I indicates the channel number of each separation signal (I=1, 2).

The separation and reproduction filter unit 5 implements filtering on input signals $x_j(t)$ (j=1, 2) for the respective channels, with use of four separation and reproduction filter coefficients $M_{ij}^{(1)}(k)$ (I=1, 2; j=1, 2). Synthesized signals $z_I^{(1)}(t)$ of the respective channels are then calculated according to the following equation (6). Here, "*" indicates a convolution operation.

$$z_i^{(1)}(t)=m_{I1}^{(1)}(s)*x_i(t)+m_{I2}^{(1)}(s)*x_2(t)I=1,2 \quad (6)$$

Like the separation and reproduction filter unit 5, the other separation and reproduction filter unit 6 implements filtering on input signals $x_j(t)$ (j=1, 2) for the respective channels, with use of four separation and reproduction filter coefficients $M_{ij}^{(2)}(k)$ (I=1, 2, j=1, 2). Synthesized signals $z_I^{(2)}(t)$ of the respective channels are then calculated according to the following equation (7).

$$z_I^{(2)}(t)=m_{I1}^{(2)}(s)*x_I(t)+m_{I2}^{(2)}(s)*x_2(t)I=1,2 \quad (7)$$

As a result of the above operation, the output terminal 7 outputs the synthesized signals $z_I^{(1)}(t)$ of the corresponding channel, the output terminal 8 outputs the synthesized signal $z_2^{(1)}(t)$ of the corresponding channel, the output terminal 9 outputs the synthesized signals $z_I^{(2)}(t)$ of the corresponding channel, and the output terminal 10 outputs the synthesized signals $z_2^{(2)}(t)$ of the corresponding channel.

{Citation List}

{Non Patent Literature}

{NPL 1} Shuxue. Ding, Masashi Otsuka, Masaki Ashizawa, Teruo Niitsuma, Kazuyoshi Sugai, "Blind source separation of real-world acoustic signals based on ICA in time-frequency-domain", Technical Report of IEICE, SP2001-1, p.p. 1-8, April 2001

SUMMARY OF THE INVENTION

Technical Problem

In a conventional signal separating and reproducing apparatus, however, there is uncertainty remaining about each separation filter and reproduction filter. Therefore, those filters cannot be calculated independently of each other. This is because, while the sizes of the matrix elements of the separation filter frequency characteristics matrix W(k) are uncertain with respect to each frequency component, an inverse frequency transform is performed only on the separation and reproduction filter frequency characteristics matrix $M_i(k)$ obtained by combining the separation filter frequency characteristics matrix W(k) and its inverse matrix $W^{-1}(k)$, so as to eliminate the uncertainty. The separation and reproduction filter coefficients $M_{ij}^{(i)}(s)$ are calculated in this manner.

In a case where a separation filter and a reproduction filter cannot be calculated separately from each other as described above, it is difficult to change the characteristics of one of the filters. Particularly, to control a localization of a sound source of channel-specific synthesized signals obtained at last, adjusting the characteristics of the reproduction filter is advantageous. In a conventional apparatus, however, it is difficult to recognize only the characteristics of the reproduction filter for the above described reasons. Therefore, it is also difficult to control the reproduction filter through external control operations.

The object of the present invention is to provide a technique for calculating a separation filter and a reproduction filter independently of each other in a signal separating and reproducing apparatus.

Solution to Problem

A signal separating and reproducing apparatus according to the present invention includes: a separation filter analyzing unit calculating a first matrix which indicates frequency characteristics of a separation filter from input signals of a plurality of channels; a filter coefficient restricting unit calculating restriction coefficients for restricting the separation filter, calculating a second matrix by using the restriction coefficients and the first matrix, and calculating separation filter coefficients by using the second matrix; a separation filter unit calculating separation signals by filtering on the input signals of the plurality of channels by using the separation filter coefficients; a reproduction filter calculating unit calculating a third matrix by transforming the second matrix into an inverse matrix at each frequency, and calculating reproduction filter coefficients by using the third matrix; and a reproduction filter unit calculating synthesized signals corresponding to the respective channels by filtering on the separation signals by using the reproduction filter coefficients, wherein the filter coefficient restricting unit calculates the restriction coefficients so that the reproduction filter coefficients indicate filter coefficients which perform a sound source localization on the separation signals.

Advantageous Effects of Invention

In accordance with the present invention, a separation filter and a reproduction filter can be calculated independently of each other. Accordingly, it is possible to independently handle the reproduction filter having a characteristic of localizing a sound source and the separation filter having other characteristics than that of the reproduction filter.

REFERENCE SIGNS LIST

Figure 1:
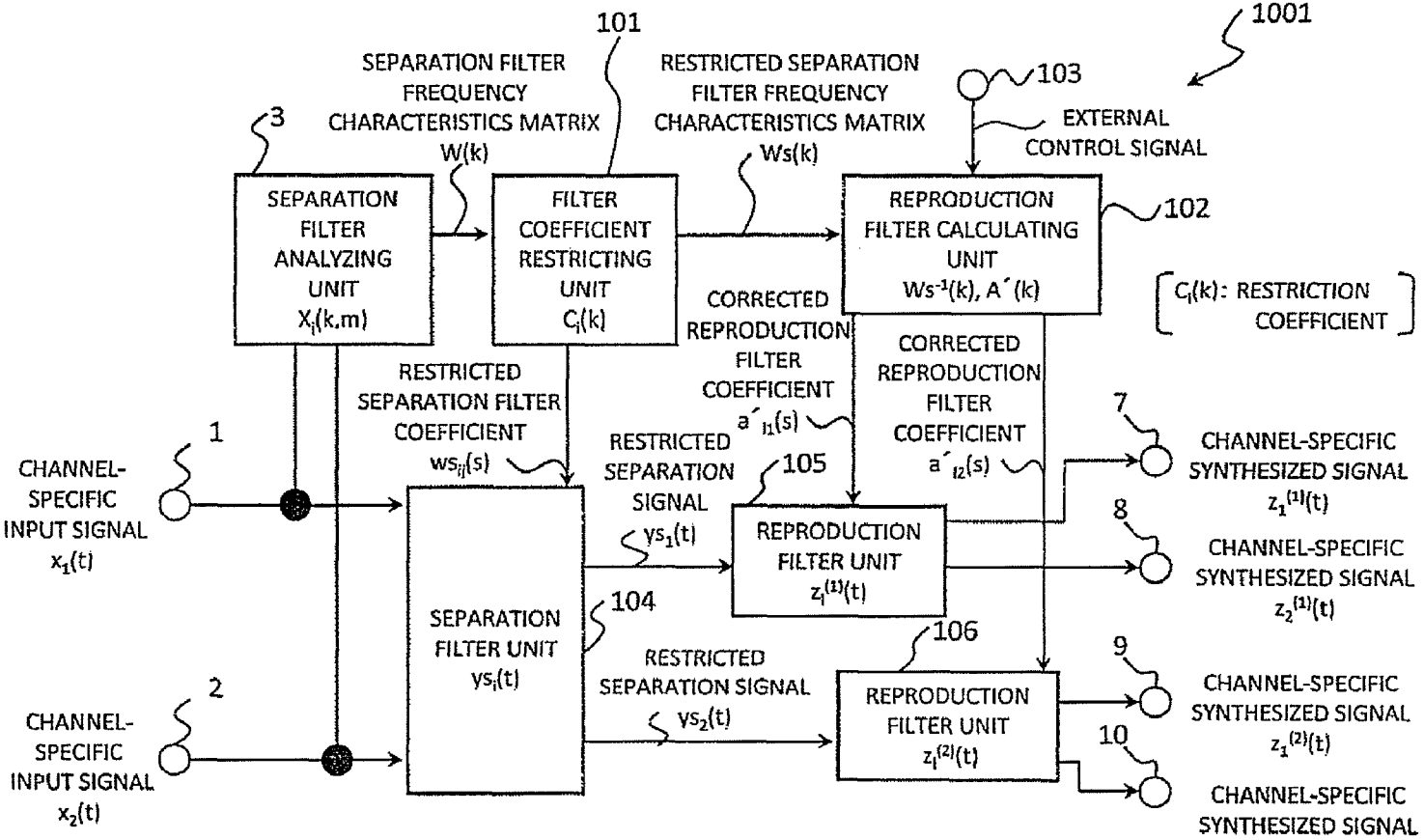
{FIG. 1} A block diagram illustrates the structure of a first embodiment of the present invention.

1, 2, 103, 121, 122: input terminal
3: separation filter analyzing unit
4: separation and reproduction filter calculating unit
5, 6: separation and reproduction filter unit
7, 8, 9, 10, 112, 113: output terminal
101: filter coefficient restricting unit
102: reproduction filter calculating unit
104: separation filter unit
105, 106: reproduction filter unit
110: reproduction filter feature quantity extracting unit
111: compression processing unit
120: reproduction filter creating unit
123: decoding unit
1000, 1001: signal separating and reproducing apparatus
1002: signal separating and reproducing system
1002A: signal separating and compressing apparatus
1002B: signal decoding and reproducing apparatus

DESCRIPTION OF EMBODIMENTS

FIG. 1 illustrates the structure of a signal separating and reproducing apparatus 1001 of a first embodiment of the present invention. The structure has two channels for input signals, like the conventional apparatus structure shown in FIG. 4. In the structure of this embodiment, the two input terminals 1 and 2, the separation filter analyzing unit 3 calculating the separation filter frequency characteristics matrix W(k), the four output terminals 7, 8, 9, and 10 are the same as those shown in FIG. 4, and therefore, explanation of them is omitted here. The separation filter frequency characteristics matrix W(k) is equivalent to the first matrix of the present invention.

A filter coefficient restricting unit 101 uses the separation filter frequency characteristics matrix W(k) calculated by the separation filter analyzing unit 3, to calculate a restricted separation filter frequency characteristics matrix Ws(k). The restricted separation filter frequency characteristics matrix Ws(k) is equivalent to the second matrix of the present invention. The filter coefficient restricting unit 101 also uses the restricted separated filter frequency characteristics matrix Ws(k), to calculate restricted separation filter coefficients $ws_{ij}(s)$. So as to eliminate the uncertainty about the size of the separation filter frequency characteristics matrix W(k), the former restricted separation filter frequency characteristics matrix Ws(k) is calculated according to the following equation (8):

{Math. 5}

$$Ws(k) = \begin{pmatrix} C_1(k) & 0 \\ 0 & C_2(k) \end{pmatrix} \cdot W(k) \tag{8}$$

Here, $C_i(k)$ (i=1, 2) indicate the restriction coefficients. The restriction coefficients $C_i(k)$ of this embodiment are calculated so that the restricted separation signals $ys_i(t)$ (i=1, 2) from the later described separation filter unit 104 become the sum signals of the synthesized signals of the respective channels.

The calculation of the restriction coefficients $C_i(k)$ is now described. The frequency characteristics of the separation signal separated by the separation filter frequency characteristics matrix W(k) are indicated as $Y_i(k)$, the frequency characteristics of the restricted separation signal separated by the restricted separation filter frequency characteristics matrix Ws(k) are indicated as $Ys_i(k)$, and the frequency characteristics of each synthesized signal of the respective channels are indicated as $z_i^i(k)$. When input acoustic signals are separated and reproduced, the synthesized signals of the respective channels to be ultimately obtained are the same, regardless of whether the separation filter frequency characteristics matrix W(k) or the restricted separation filter frequency characteristics Ws(k) is used. This is because uncertainty is not caused in separation and reproduction filters. In view of the above, the following equations (9) and (10) are established:

{Math. 6}

$$Ys_i(k) = \begin{pmatrix} C_1(k) & 0 \\ 0 & C_2(k) \end{pmatrix} \cdot Y_i(k) \tag{9}$$

-continued $$\begin{pmatrix} Z_1^i(k) \\ Z_2^i(k) \end{pmatrix} = W^{-1}(k) \cdot P_i(k) \cdot \begin{pmatrix} Y_1(k) \\ Y_2(k) \end{pmatrix} \tag{10}$$

Also, the conditions under which the restricted separation signal $ys_i(t)$ becomes equal to the sum signal of synthesized signals of respective channels can be expressed by the following equation (11):

$$Ys_i(k) = z_1^i(k) + z_2^i(k) \tag{11}$$

Accordingly, the restricted coefficient $C_i(k)$ should be calculated so as to satisfy the above equation (11). More specifically, the restricted coefficient $C_i(k)$ is calculated according to the following equations (12) and (13):

{Math. 7}

$$C_1(k) = \frac{1}{W_{11}(k) \cdot W_{22}(k) - W_{12}(k) \cdot W_{21}(k)} \cdot (W_{22}(k) - W_{21}(k)) \tag{12}$$

$$C_2(k) = \frac{1}{W_{11}(k) \cdot W_{22}(k) - W_{12}(k) \cdot W_{21}(k)} \cdot (W_{11}(k) - W_{12}(k)) \tag{13}$$

The filter coefficient restricting unit 101 performs an inverse frequency transform on the restricted separation filter frequency characteristics matrix Ws(k) calculated according to the above equation (8), for each matrix element $Ws_{ij}(k)$ (i=1, 2; j=1, 2). By doing so, the filter coefficient restricting unit 101 calculates four restricted separation filter coefficients $ws_{ij}(s)$ (s=0, 1, 2, . . . , N−1).

The reproduction filter calculating unit 102 uses the restricted separation filter frequency characteristics matrix Ws(k) calculated by the filter coefficient restricting unit 101, so as to calculate corrected reproduction filter coefficients $a'_{ij}(s)$ (s=0, 1, 2, . . . , N−1). To do so, the reproduction filter calculating unit 102 first calculates the restricted reproduction filter frequency characteristics matrix $Ws^{-1}(k)$ by transforming the restricted separation filter frequency characteristics matrix Ws(k) into an inverse matrix at the respective frequencies. The matrix $Ws^{-1}(k)$ is equivalent to the third matrix of the present invention. With the restricted reproduction filter frequency characteristics matrix $Ws^{-1}(k)$ being used, the synthesized signals of the respective channels are expressed by the following equation (14):

{Math. 8}

$$\begin{pmatrix} Z_1^i(k) \\ Z_2^i(k) \end{pmatrix} = Ws^{-1}(k) \cdot P_i(k) \cdot \begin{pmatrix} Ys_1(k) \\ Ys_2(k) \end{pmatrix} \tag{14}$$

By adding the equation (11) expressing that the restricted separation signal $ys_i(t)$ is equal to the sum signal of the synthesized signals of the respective channels, to the equation (14), the relationships expressed by the following equations (15) and (16) are established:

{Math. 9}

$$\begin{pmatrix} Z_1^1(k) \\ Z_2^1(k) \end{pmatrix} = Ws^{-1}(k) \cdot \begin{pmatrix} Z_1^1(k) + Z_2^1(k) \\ 0 \end{pmatrix} \tag{15}$$

-continued $$\begin{pmatrix} Z_1^2(k) \\ Z_2^2(k) \end{pmatrix} = Ws^{-1}(k) \cdot \begin{pmatrix} 0 \\ Z_1^2(k) + Z_2^2(k) \end{pmatrix} \quad (16)$$

The filter characteristics indicated as the corrected reproduction filter coefficients $a'_{Ii}(s)$ can be such characteristics that retransform the sum signal of the synthesized signals of the channels into the synthesized signals of the respective channels, that is, characteristics which performs a localization of a sound source on the restricted separation signals $ys_i(t)$. This is based on the fact that the filter coefficient restricting unit 101 calculates the restriction coefficients $C_i(k)$ so that the restricted separation signal $ys_i(t)$ becomes equal to the sum signal of the synthesized signals of each channel.

Where the matrix elements of the restricted reproduction filter frequency characteristics matrix $Ws^{-1}(k)$ are indicated as $A_{Ii}(k)$ (I=1, 2; i=1, 2), the relationship among the matrix elements is expressed by the following equation (17):

$$A_{1i}(k)+A_{2i}(k)=1 \quad (17)$$

Here, the amplitude difference CLD and the phase difference CPD between the channels of the synthesized signals are explained. It is a known fact that the amplitude difference CLD and the phase difference CPD between the channels are important aspects for feeling the localization of a sound source where the separation signals come from. The amplitude difference CLD and the phase difference CPD between the channels of the synthesized signals are expressed by the following equations (18) and (19):

$$CLDi(k)=|A_{2i}(k)|/|A_{1i}(k)| \quad (18)$$

$$CPDi(k)=\angle A_{2i}(k)-\angle A_{1i}(k) \quad (19)$$

Here, "|A|" is the amplitude of a complex number A, and "∠A" is the phase of the complex number A.

The reproduction filter calculating unit 102 calculates the corrected reproduction filter frequency characteristics matrix A'(k) by correcting the restricted reproduction filter frequency characteristics matrix $Ws^{-1}(k)$ in accordance with an external control signal that is supplied via the output terminal 103. The matrix elements of the corrected reproduction filter frequency characteristics matrix A'(k) are indicated as $A'_{Ii}(k)$ (I=1, 2; i=1, 2). For example, the localized position of the sound source of the corrected synthesized signals or CLD and CPD may be used as the external control signal.

As an example of the correction technique, an operation to be performed when only CLD is supplied as the external control signal is described. With CLD supplied through external control being βi(k), the energy of the restricted reproduction filter frequency characteristics matrix $Ws^{-1}(k)$ is calculated according to the following equation (20):

{Math. 10}

$$\sum_{k=0}^{N/2-1} |A_{1i}(k)|^2 \quad (20)$$

The number of the channel having a large energy is then selected for each separation signal. If the selection result is "I=1", for example, the matrix element $A'_{1i}(k)$ of the corrected restriction filter frequency characteristics matrix A'(k) corresponding to the channel number "I=1" is calculated so as to satisfy the following equations (21) and (22):

{Math. 11}

$$\frac{|(1 - A'_{1i}(k))|}{|A'_{1i}(k)|} = \beta_i(k) \quad (21)$$

$$\angle A'_{1i}(k) = \angle A_{1i}(k) \quad (22)$$

Also, in accordance with the relationship between the calculated matrix element $A'_{1i}(k)$ and the following equation (23) based on the equation (17), the matrix element $A'_{2i}(k)$ corresponding to the other channel number "I=2" is calculated:

$$A'_{1i}(k)+A'_{2i}(k)=1 \quad (23)$$

The reproduction filter calculating unit 102 calculates four corrected reproduction filter coefficients $a'_{Ii}(s)$ (s=0, 1, 2, . . . , N−1) by performing an inverse frequency transform on each matrix element $A'_{Ii}(k)$ (I=1, 2; i=1, 2) of the corrected reproduction filter frequency characteristics matrix A'(k) obtained by the above result.

The separation filter unit 104 uses the four restricted separation filter coefficients $ws_{ij}(s)$ (i=1, 2; j=1, 2) calculated by the filter coefficient restricting unit 101, so as to perform filtering on the input signals $x_j(t)$ (j=1, 2) of the respective channels, and calculates the restricted separation signals $ys_i(t)$ according to the following equation (24):

$$ys_i(t)=ws_{i1}(s)*x_1(t)+ws_{i2}(s)*x_2(t)i=1,2 \quad (24)$$

The reproduction filter unit 105 uses the two corrected reproduction filter coefficients $a'_{I1}(s)$ (I=1, 2) to perform filtering on the restricted separation signal $ys_i(t)$, and calculates the synthesized signal $z_I^{(1)}(t)$ of each channel according to the following equation (25):

$$z_I^{(1)}(t)=a'_{I1}(s)*x_I(t)I=1,2 \quad (25)$$

The reproduction filter unit 106 uses the two corrected reproduction filter coefficients $a'_{I2}(s)$ (I=1, 2) to perform filtering on the restricted separation signal $ys_2(t)$, and calculates the synthesized signal $z_I^{(2)}(t)$ of each channel according to the following equation (26):

$$z_I^{(2)}(t)=a'_{I2}(s)*x_2(t)I=1,2 \quad (26)$$

As a result of the above operation, the output terminal 7 outputs the synthesized signal $z_I^{(1)}(t)$ of the corresponding channel, the output terminal 8 outputs the synthesized signal $z_2^{(1)}(t)$ of the corresponding channel, the output terminal 9 outputs the synthesized signal $z_I^{(2)}(t)$ of the corresponding channel, and the output terminal 10 outputs the synthesized signal $z_2^{(2)}(t)$ of the corresponding channel.

In accordance with this embodiment, the filter coefficient restricting unit 101 calculates the separation filter coefficients $ws_{ij}(s)$, so that the restricted separation signals $ys_i(t)$ are the sum signals of the synthesized signals of the respective channels. Accordingly, separation filters can be calculated independently of reproduction filters. Furthermore, the filter characteristics indicated as the corrected reproduction filter coefficients $a'_{Ii}(s)$ are such characteristics that retransform the sum signal of the synthesized signals of the respective channels into the synthesized signals of the respective channels, that is, the characteristic of localizing the sound source. Thus, the reproduction filter calculating unit 102 can control the sound source localization of the synthesized signals in accordance with external control signals.

Figure 2:
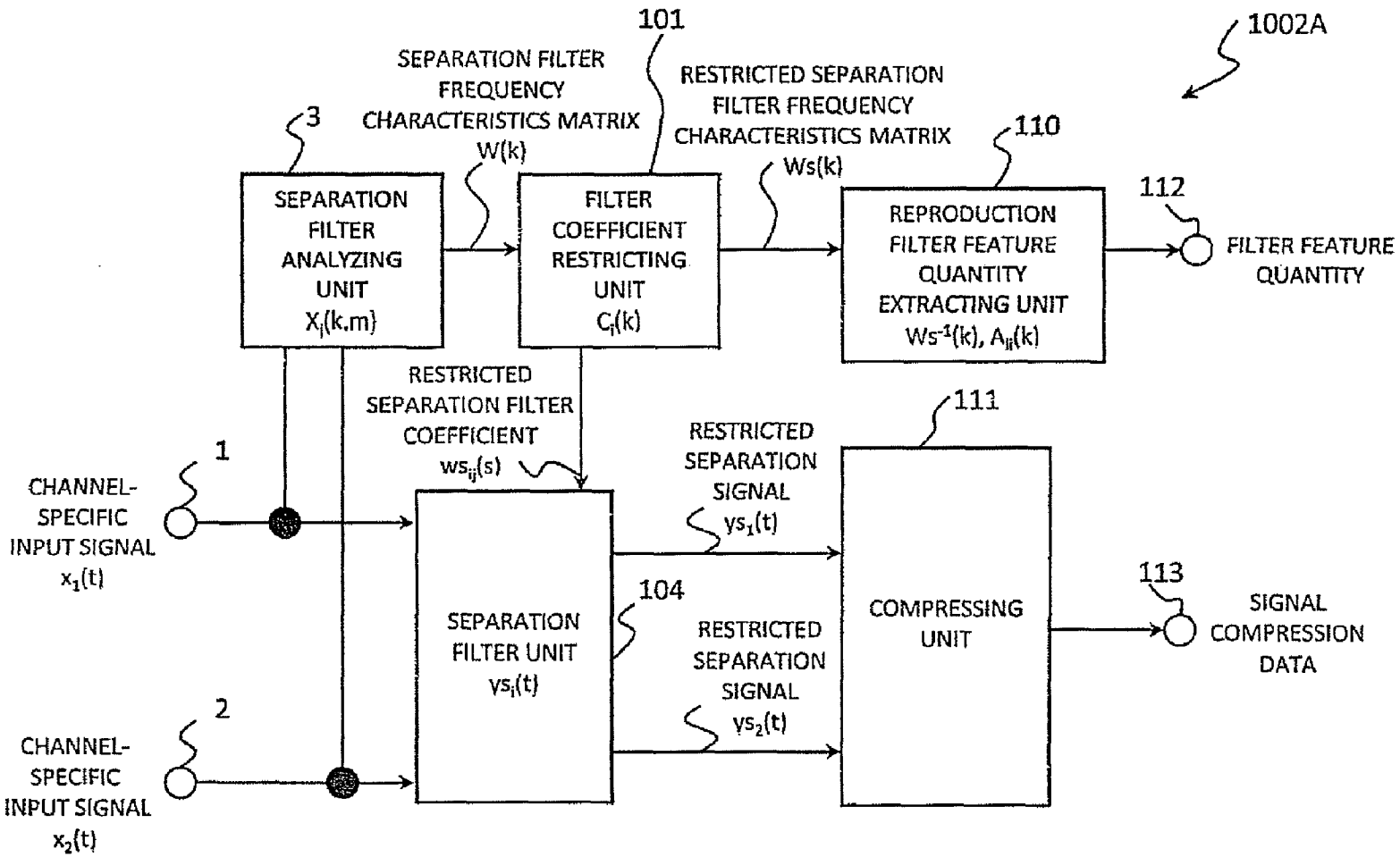
{FIG. 2} A block diagram illustrates the structure of a second embodiment of the present invention.

Next, a second embodiment of the present invention is described in detail, with reference to the accompanying drawings. This embodiment concerns a signal separating and compressing apparatus that separates and compresses input acoustic signals. FIG. 2 shows the structure of the signal separating and compressing apparatus 1002A. In this structure, the two input terminals 1 and 2 and the separation filter analyzing unit 3 are the same as those of the signal separating and reproducing apparatus 1000 shown in FIG. 4. Also, the filter coefficient restricting unit 101 and the separation filter unit 104 are the same as those of the signal separating and reproducing apparatus 1001 shown in FIG. 1.

A reproduction filter feature quantity extracting unit 110 calculates the restricted reproduction filter frequency characteristics matrix $Ws^{-1}(k)$ which is the inverse matrix formed from the restricted separation filter frequency characteristics matrix Ws(k) calculated by the filter coefficient restricting unit 101. The inversion is performed at each frequency. Further, the matrix elements $A_{Ii}(k)$ (I=1, 2; i=1, 2) of the restricted reproduction filter frequency characteristics matrix $Ws^{-1}(k)$ are quantized and encoded in each sub band, and the filter feature quantities are output to an output terminal 112. The sub bands may be defined in an unjustified dividing manner such as the Barkscale, or may be defined based on the restricted reproduction filter frequency characteristics matrix.

A compressing unit 111 compresses the restricted separation signals $ys_i(t)$ (i=1, 2) calculated by the separation filter unit 104, and outputs the compressed signals as signal compression data to an output terminal 113. In the compressing process, for example, the restricted separations signals $ys_i(t)$ may be compressed independently of one another by a transform coding technique that is known as one of the techniques for efficiently encoding audio signals of music and the likes.

Like the filter coefficient restricting unit 101 of the first embodiment, the filter coefficient restricting unit 101 of this embodiment calculates separation filter coefficients $ws_{ij}(s)$ so that the restricted separation signals $ys_i(t)$ are equivalent to the sum signals of the synthesized signals of the respective channels. Accordingly, in accordance with this embodiment, acoustic input signals can be separated and reproduced independently of one another. Also, the signal separating and compressing apparatus 1002A of this embodiment compresses the separation signals $ys_i(t)$ obtained through separating operations, and then outputs the compressed signals. Accordingly, the separation signals can be transmitted together with filter feature quantity information to other apparatus, for example.

Figure 3:
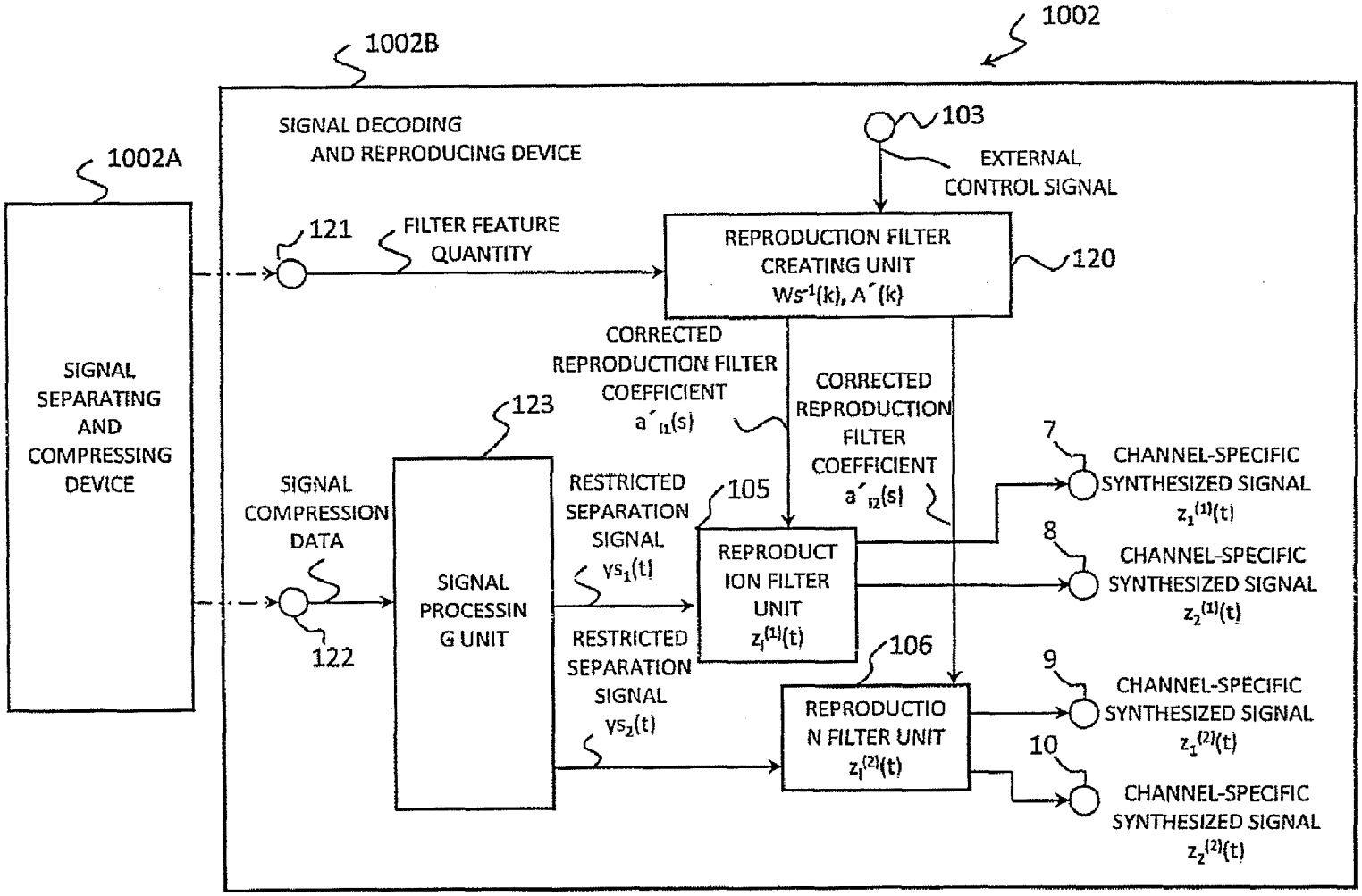
{FIG. 3} A block diagram illustrates the structure of a third embodiment of the present invention.

Next, a third embodiment of the present invention is described in detail, with reference to the accompanying drawings. This embodiment concerns a signal separating and reproducing system 1002 that includes the signal separating and compressing apparatus 1002A, and a signal decoding and reproducing apparatus 1002B that is connected to the signal separating and compressing apparatus 1002A and performs reproducing operations. FIG. 3 shows the structure of the system 1002.

Figure 4:
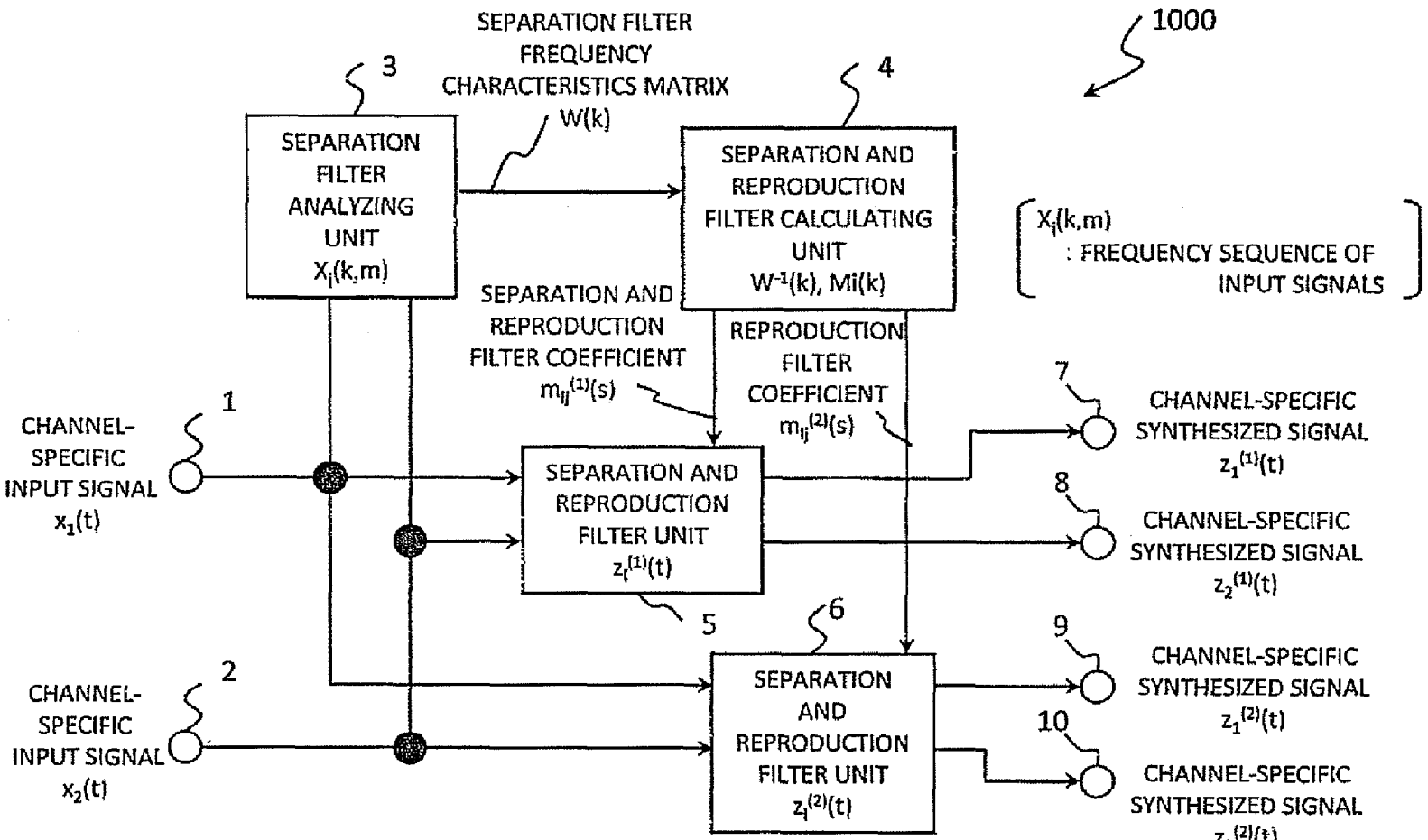
{FIG. 4} A block diagram illustrates the structure of a conventional signal separating and reproducing apparatus.

In the structure of the signal decoding and reproducing apparatus 1002B, the four output terminals 7, 8, 9, and 10 are the same as those of the signal separating and reproducing apparatus 1000 shown in FIG. 4. The output terminal 103, the reproduction filter unit 105, and the reproduction filter unit 106 are the same as those of the signal separating and reproducing apparatus 1001 shown in FIG. 1.

A reproduction filter creating unit 120 calculates the restricted reproduction filter frequency characteristics matrix $Ws^{-1}(k)$, based on the filter feature quantities supplied from the signal separating and compressing apparatus 1002A via an input terminal 121. Like the reproduction filter calculating unit 102 (FIG. 1), the reproduction filter creating unit 120 then corrects the restricted reproduction filter frequency characteristics matrix $Ws^{-1}(k)$ in accordance with external control signals supplied from the output terminal 103, so as to calculate the corrected reproduction filter frequency characteristics matrix A'(k). The reproduction filter creating unit 120 further performs an inverse frequency transform on each of the matrix elements of the calculated corrected reproduction filter coefficient characteristics matrix A'(k), so as to calculate the four corrected reproduction filter coefficients $a'_{Ii}(s)$.

A decoding unit 123 performs decoding on the signal compression data supplied from the signal separating and compressing apparatus 1002A via an input terminal 122, so as to generate the restricted separation signals $ys_i(t)$. This decoding operation is the opposite operation of the operation performed by the compressing unit 104 (FIG. 2), and may be performed by a decoding technique of a transform coding method known as one of the techniques for efficiently coding audio signals of music and the likes.

In accordance with this embodiment, the filter characteristics indicated as the corrected reproduction filter coefficients $a'_{Ii}(s)$ are the characteristic of localizing the sound source, the same as in the first embodiment. Thus, the reproduction filter calculating unit 102 can control the sound source localization of the synthesized signals in accordance with the external control signals.

In each of the above embodiments, the restriction coefficients $C_i(k)$ are calculated so that a filter characteristics obtained by adding all the channels of the corrected reproduction filter coefficients $a'_{Ii}(s)$ has an entire bandpass characteristics, that is, all the synthesized signals contained in the separation signals $ys_i(t)$ are output from the reproduction filter units (105, 106). However, it is also possible to calculate the restriction coefficient $C_i(k)$ so that the synthesized signals contained in the separation signals are partially output.

INDUSTRIAL APPLICABILITY

The present invention can be applied to various structures that separate and generate original signals from mixed signals of acoustic and voice signals. Also, the present invention may be realized by a computer program.

The invention claimed is:

1. A signal separating and reproducing apparatus comprising:

a separation filter analyzing unit calculating a first matrix which indicates frequency characteristics of a separation filter from input signals of a plurality of channels;

a filter coefficient restricting unit calculating restriction coefficients for restricting the separation filter, calculating a second matrix by using the restriction coefficients and the first matrix, and calculating separation filter coefficients by using the second matrix;

a separation filter unit calculating separation signals by filtering on the input signals of the plurality of channels by using the separation filter coefficients;

a reproduction filter calculating unit calculating a third matrix by transforming the second matrix into an inverse matrix at each frequency, and calculating reproduction filter coefficients by using the third matrix; and a reproduction filter unit calculating synthesized signals corresponding to the respective channels by filtering on the separation signals by using the reproduction filter coefficients, wherein the filter coefficient restricting unit calculates the restriction coefficients so that the reproduction filter coefficients indicate filter coefficients which perform a sound source localization on the separation signals.

2. The signal separating and reproducing apparatus according to claim 1, wherein the reproduction filter calculating unit corrects the third matrix in accordance with a control signal for controlling a characteristic of the sound source localization of the separation signals.

3. The signal separating and reproducing apparatus according to claim 2, wherein, when the control signal indicates a difference in amplitude between channels of synthesized signals, the reproduction filter calculating unit calculates signal energy of each channel by using the third matrix, and corrects the third matrix based on a difference in the calculated signal energy and the difference in amplitude between the channels.

4. The signal separating and reproducing apparatus according to claim 1, wherein the filter coefficient restricting unit calculates the restriction coefficients so that a filter coefficient obtained by adding the reproduction filter coefficients to all the plurality of channels has an entire bandpass characteristic.

5. A computer-readable medium storing therein a program causing to have a computer to function as the signal separating and reproducing apparatus according to claim 1.

6. A signal separating and compressing apparatus comprising:

a separation filter analyzing unit calculating a first matrix which indicates frequency characteristics of a separation filter from input signals of a plurality of channels;

a filter coefficient restricting unit calculating restriction coefficients for restricting the separation filter, calculating a second matrix by using the restriction coefficients and the first matrix, and calculating separation filter coefficients by using the second matrix;

a separation filter unit calculating separation signals by filtering on the input signals of the plurality of channels by using the separation filter coefficients;

a compressing unit compressing the separation signals; and a feature quantity extracting unit calculating a third matrix by transforming the second matrix into an inverse matrix at each frequency, and extracting a feature quantity of the third matrix, wherein the filter coefficient restricting unit calculates the restriction coefficients so that the third matrix indicates filter coefficients which perform a sound source localization on the separation signals.

7. A computer-readable medium storing therein a program causing to have a computer to function as the signal separating and compressing apparatus according to claim 6.

8. A signal decoding and reproducing apparatus comprising:

a reproduction filter creating unit calculating a third matrix based on feature quantities and calculating reproduction filter coefficients by using the third matrix, when the feature quantities of the third matrix obtained by transforming a second matrix, as a result of a calculation between a first matrix indicating frequency characteristics of a separation filter and restriction coefficients for restricting the separation filter, into an inverse matrix at each input frequency;

a decoding unit decoding separation signals when the separation signals as results of filtering implemented on input signals of a plurality of channels using separation filter coefficients calculated from the second matrix are compressed and input; and a reproduction filter unit calculating synthesized signals corresponding to the respective channels by filtering on the decoded separation signals by using the reproduction filter coefficients, wherein the reproduction filter creating unit corrects the third matrix in accordance with a control signal for controlling a characteristic of a sound source localization of the separation signals.

9. The signal decoding and reproducing apparatus according to claim 8, wherein, when the control signal indicates a difference in amplitude between channels of synthesized signals, the reproduction filter creating unit calculates signal energy of each channel by using the third matrix, and corrects the third matrix based on the difference in the calculated signal energy and the difference in amplitude between the channels.

10. A computer-readable medicum storing therein a program causing to have a computer to function as the signal decoding and reproducing apparatus according to claim 8.

11. A signal separating and reproducing system comprising:

the signal separating and compressing apparatus according to claim 6; and a signal decoding and reproducing apparatus comprising;

a reproduction filter creating unit calculating a third matrix based on feature quantities and calculating reproduction filter coefficients by using the third matrix, when the feature quantities of the third matrix obtained by transforming a second matrix, as a result of a calculation between a first matrix indicating frequency characteristics of a separation filter and restriction coefficients for restricting the separation filter, into an inverse matrix at each input frequency;

a decoding unit decoding separation signals when the separation signals as results of filtering implemented on input signals of a plurality of channels using separation filter coefficients calculated from the second matrix are compressed and input; and a reproduction filter unit calculating synthesized signals corresponding to the respective channels by filtering on the decoded separation signals by using the reproduction filter coefficients, wherein the reproduction filter creating unit corrects the third matrix in accordance with a control signal for controlling a characteristic of a sound source localization of the separation signals.

12. A signal separating and reproducing method comprising steps of:

calculating a first matrix which indicates frequency characteristics of a separation filter from input signals of a plurality of channels;

calculating restriction coefficients for restricting the separation filter, calculating a second matrix by using the restriction coefficients and the first matrix, and calculating separation filter coefficients by using the second matrix;

calculating separation signals by filtering on the input signals of the plurality of channels by using the separation filter coefficients;

calculating a third matrix by transforming the second matrix into an inverse matrix at each frequency, and calculating reproduction filter coefficients by using the third matrix; and calculating synthesized signals corresponding to the respective channels by filtering on the separation signals by using the reproduction filter coefficients, wherein the restriction coefficients are calculated so that the reproduction filter coefficients indicate filter coefficients which perform a sound source localization on the separation signals.

13. The signal separating and reproducing method according to claim 12, further comprising a step of correcting the third matrix in accordance with a control signal for controlling a characteristic of the sound source localization of the separation signals.

14. The signal separating and reproducing method according to claim 13, wherein, when the control signal indicates a difference in amplitude between channels of synthesized signals, signal energy of each channel is calculated by using the third matrix, and the third matrix is corrected based on a difference in the calculated signal energy and the difference in amplitude between the channels.

15. The signal separating and reproducing method according to claim 12, wherein the restriction coefficients are calculated so that a filter coefficient obtained by adding the reproduction filter coefficients to all the plurality of channels has an entire bandpass characteristic.

16. A signal separating and compressing method comprising steps of:

calculating a first matrix which indicates frequency characteristics of a separation filter from input signals of a plurality of channels;

calculating restriction coefficients for restricting the separation filter, calculating a second matrix by using the restriction coefficients and the first matrix, and calculating separation filter coefficients by using the second matrix;

calculating separation signals by filtering on the input signals of the plurality of channels by the separation filter coefficients;

compressing the separation signals; and calculating a third matrix by transforming the second matrix into an inverse matrix at each frequency, and extracting a feature quantity of the third matrix, wherein the restriction coefficients are calculated so that the third matrix indicates filter coefficients which perform a sound source localization on the separation signals.

17. A signal decoding and reproducing method comprising:

calculating a third matrix based on feature quantities and calculating reproduction filter coefficients by using the third matrix, when the feature quantities of the third matrix obtained by transforming a second matrix, as a result of a calculation between a first matrix indicating frequency characteristics of a separation filter and restriction coefficients for restricting the separation filter, into an inverse matrix at each frequency is input;

decoding separation signals when the separation signals as results of filtering implemented on input signals of a plurality of channels using separation filter coefficients calculated from the second matrix are compressed and input; and calculating synthesized signals corresponding to the respective channels by filtering on the decoded separation signals by using the reproduction filter coefficients, wherein the decoded third matrix is corrected in accordance with a control signal for controlling a characteristic of a sound source localization of the separation signals.

18. The signal decoding and reproducing method according to claim 17, wherein, when the control signal indicates a difference in amplitude between channels of synthesized signals, signal energy of each channel is calculated by using the third matrix, and the third matrix is corrected based on the difference in the calculated signal energy and the difference in amplitude between the channels.

* * * * *